US010274189B2

(12) United States Patent
Wagoner

(10) Patent No.: US 10,274,189 B2
(45) Date of Patent: Apr. 30, 2019

(54) MECHANISM FOR DISPLAY OF ART WORK BACKLIT BY LED LIGHTING

(71) Applicant: David Frederick Wagoner, Silver Spring, MD (US)

(72) Inventor: David Frederick Wagoner, Silver Spring, MD (US)

( * ) Notice: Subject to any disclaimer, the term of this patent is extended or adjusted under 35 U.S.C. 154(b) by 0 days.

(21) Appl. No.: 15/915,776

(22) Filed: Mar. 8, 2018

(65) Prior Publication Data

US 2018/0259177 A1 Sep. 13, 2018

Related U.S. Application Data

(60) Provisional application No. 62/469,280, filed on Mar. 9, 2017.

(51) Int. Cl.

| | |
|---|---|
| ***F21V 33/00*** | (2006.01) |
| ***F21V 7/00*** | (2006.01) |
| ***F21V 7/22*** | (2018.01) |
| ***A47G 1/06*** | (2006.01) |
| *F21V 17/16* | (2006.01) |
| *F21Y 115/10* | (2016.01) |
| *F21W 131/304* | (2006.01) |
| *F21Y 103/20* | (2016.01) |

(52) U.S. Cl.

CPC ..... *F21V 33/0032* (2013.01); *A47G 1/0622* (2013.01); *F21V 7/0008* (2013.01); *F21V 7/0025* (2013.01); *F21V 7/22* (2013.01); *F21V 17/164* (2013.01); *F21W 2131/304* (2013.01); *F21Y 2103/20* (2016.08); *F21Y 2115/10* (2016.08)

(58) Field of Classification Search

CPC .. F21V 33/0032; F21V 7/0008; F21V 7/0025; A47G 1/0622

See application file for complete search history.

(56) References Cited

U.S. PATENT DOCUMENTS 2,677,909 A * 5/1954 Heydenryk ..... A47G 1/0622 40/559
3,742,203 A * 6/1973 Noe ..... F21V 19/02 362/220

(Continued)

OTHER PUBLICATIONS

Phototech, L. D. (n.d.). Light Boxes & Backlit Signs | Custom Manufacturing | Buy Direct. Retrieved Mar. 6, 2018, from https://www.lightboxes.com/.

(Continued)

*Primary Examiner* — Gary C Hoge

(74) *Attorney, Agent, or Firm* — Dunlap Bennett & Ludwig PLLC; Brendan E. Squire

(57) ABSTRACT

A back lit artwork frame provides an illuminated frame for hanging an item of artwork. The frame includes a channel that receives a plurality of LED lights and a diffuser that directs light emitted by the LEDs to the lateral sides of the frame. In some embodiments the light is directed towards a wall surface. In other embodiments the light is reflected outwardly from the wall. The backlit frame includes a controller which may regulate the intensity, color, pulse and other behaviors of the lighting. The LED lighting may also operate in response to an audio input. The controller may communicate with an app on a mobile device.

9 Claims, 3 Drawing Sheets

(56) References Cited

U.S. PATENT DOCUMENTS

| | | | | |
|---|---|---|---|---|
| 5,265,357 | A * | 11/1993 | Yu | G09F 19/12 362/604 |
| 7,661,216 | B1 * | 2/2010 | Wampler | G09F 13/04 40/714 |
| 9,375,103 | B1 * | 6/2016 | Hoppaugh | A47G 1/0622 |
| 2007/0089345 | A1 * | 4/2007 | Ericson | G07F 17/3211 40/793 |
| 2014/0305015 | A1 * | 10/2014 | Zelbacher | A47G 1/0622 40/714 |

OTHER PUBLICATIONS

Snap-Frames-4Sale: More Poster Snap Frames Sizes and Styles | Aluminum Snap Frame Displays | Snap Open Frames. (n.d.). Retrieved Mar. 6, 2018, from http://www.snapframes4sale.com/.

Displays4Sale: Designing, Mfg. and Distributing Frames, Displays and Fixtures for all Industries—Markets. (n.d.). Retrieved Mar. 6, 2018, from https://www.displays4sale.com/.

Poster light boxes—illuminated poster display. (n.d.). Retrieved Mar. 6, 2018, from http://www.sign-holders.co.uk/Light-boxes/c-1-36/.

* cited by examiner

MECHANISM FOR DISPLAY OF ART WORK BACKLIT BY LED LIGHTING

CROSS-REFERENCE TO RELATED APPLICATION

This application claims the benefit of priority of U.S. provisional application No. 62/469,280, filed Mar. 9, 2017, the contents of which are herein incorporated by reference.

BACKGROUND OF THE INVENTION

The present invention relates to framing for artwork, and more particularly, to an art frame backlit by LEDs (light-emitting diodes) to enhance the artwork.

There exist multiple modes of creatively displaying or "lighting up" artwork. Other devices, however, require painting original works thereby limiting the variety of artwork that may be used. Often, fluorescent paint reactive to dim UV-A light is used, which is dim and not visible to the human eye. This results in a poorly illuminated space.

There exists a need for a device that displays and lights an existing piece of artwork in a variety of color and behavioral schemes.

As can be seen, there is a need for an apparatus and method for illuminating artwork.

SUMMARY OF THE INVENTION

In one aspect of the present invention a device for displaying a piece of artwork is disclosed. The device includes a frame for mounting the artwork; a plurality of LED lights which are integrated with the frame, wherein the LED lights backlight the artwork; and a controller for controlling the LED lights.

The frame may include a channel defined in a surface of the frame. A rail is received within the channel with the plurality of LED lights received within the rail. A light transmitting rail cover is received within the rail to cover the plurality of LED lights. A diffuser may be attached at a proximal end to the frame and is disposed in a spaced relation from the rail cover. A light emitting gap is defined between the diffuser and the frame at a distal end of the diffuser.

In some embodiments, a plurality of light reflective protrusions are defined on an inner surface of the diffuser. The plurality of light reflective protrusions reflect a light emitted by the LED through the light emitting gap. In alternative embodiments, a reflective layer is formed on an inner surface of the diffuser, wherein the reflective layer reflects a light emitted by the LED through the light emitting gap.

In yet other embodiments, the diffuser is formed having a two part construction, including an interior portion and an exterior portion. A mounting tab is defined at a proximal end of the interior portion is attached to an inner edge of the frame. An angle arm that continuously diverges from the rail cover extends upwardly and outwardly from the mounting tab and terminates at a distal end of the diffuser. The exterior portion is attached at a first end to the rail and projects inwardly so that a distal end of the exterior portion is subjacent to the distal end of the interior portion. The illumination gap is defined between the distal ends of the interior and exterior portions of the diffuser.

In still other embodiments, the back lit frame includes a substrate occupying an interior space bounded by the frame.

It may also include an artwork mounted to the substrate. And in yet other embodiments, the frame includes a transparent layer overlying the artwork.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
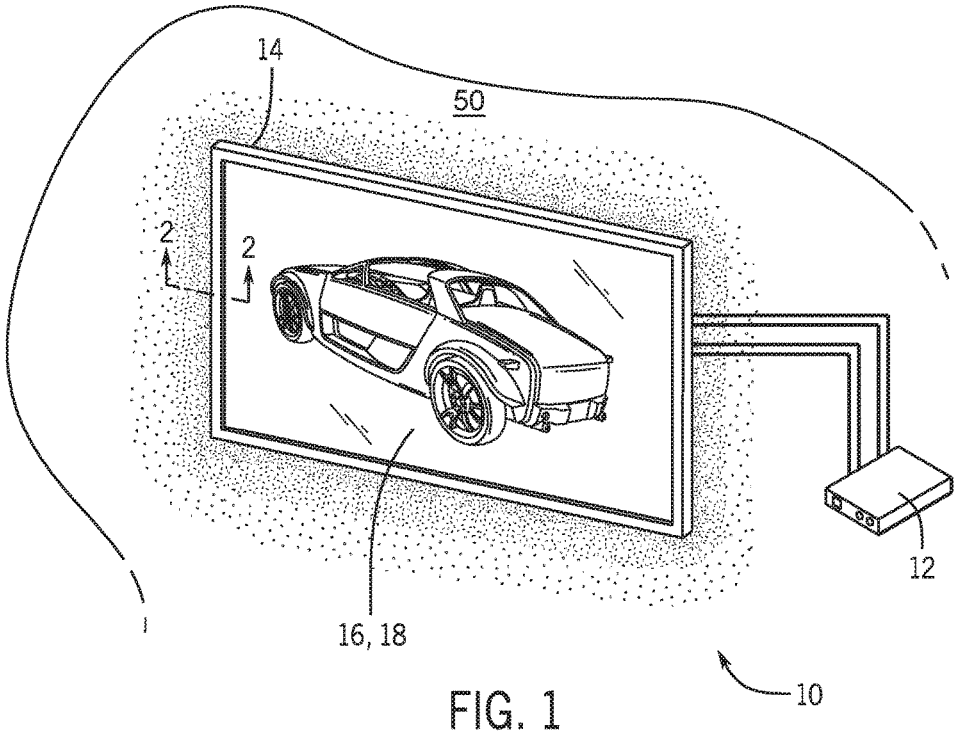
FIG. 1 is a perspective view of the backlit frame shown in use.

As seen in reference to FIG. 1, the backlit art frame 10 includes a frame 14, formed of wood, plastic, metal, composite, or other suitable materials for mounting artwork 18 to a wall surface 50 of a structure. The artwork 18 is lit using a plurality of LEDs 26 that are carried by the frame 14 and are controlled by an electronic controller 12. Advantageously, the displayed artwork 18 can be on fabric, opaque, clear plastic, or glass and can be illuminated using LED elements 26 that glow in varying colors, intensity and lighting behaviors (e.g., flash, strobe, audio response).

Beneficially, the backlit art frame 10 can display and light artwork 18 in a variety of color and behavioral schemes. Additionally, virtually any other artwork may be cast onto the medium (fabric, glass, plastic) providing unlimited options for artwork displayed.

Figure 2A:
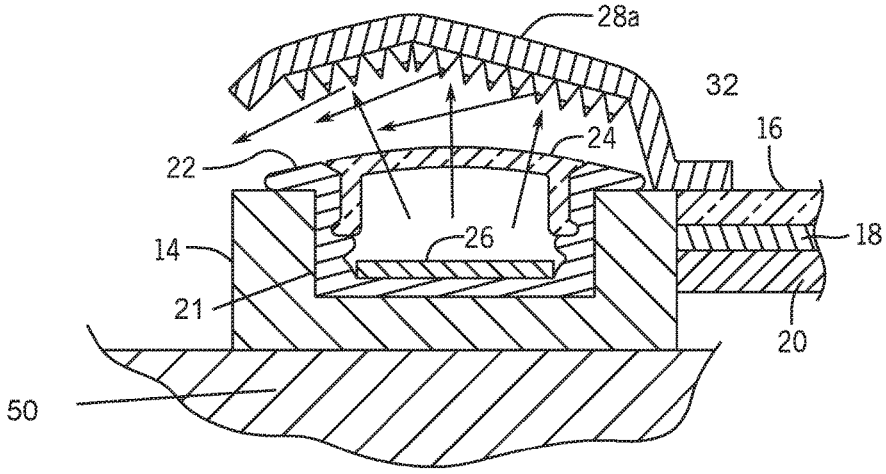
FIG. 2A is a cross-sectional view of the backlit frame taken on line 2-2 of FIG. 1.

FIG. 2 shows a first embodiment of a backlit frame 10 for lighting artwork 18. As seen in FIG. 2, the frame 14 includes a recessed channel 21. A rail 22, preferably formed of aluminum or other lightweight metal, is mounted within the recessed channel 21. A plurality of LEDs 26 or an LED strip 26 is securely mounted within the aluminum rail 22. A light transmitting rail cover 24 can be mounted on the rail 22 in a snap fit arrangement, covering the LEDs 26 within. An interior space bounded by the frame 14 includes a substrate 20 or backing to which the artwork 18 may be affixed or mounted. A transparent layer 16, may also be included to cover the artwork 18.

A diffuser 28*a* is positioned above and spaced apart from the light transmitting rail cover 24. The diffuser 28*a* includes a mounting tab 32 to secure the diffuser 28*a* to the frame 14 adjacent to the rail 22. A portion of the mounting tab 32 overlaps with a peripheral edge surface of the transparent layer 16. An interior surface of the diffuser 28*a* includes a plurality of protrusions 34 disposed on an angular arm 36 of the diffuser 28*a* such that the angular arm 36 and the protrusions 34 are configured to reflect the light emitted by the LEDs 26 outwardly through an illumination gap 38 extending around the periphery of the frame 14 between the frame 14 and the diffuser 28*a* and a distal end of the angular arm 36. Preferably, the angular arm 36 and protrusions are configured to reflect the emitted light in an outward and rearward direction so as to illuminate a wall surface upon which the backlit art frame 10 is mounted.

Figure 2B:
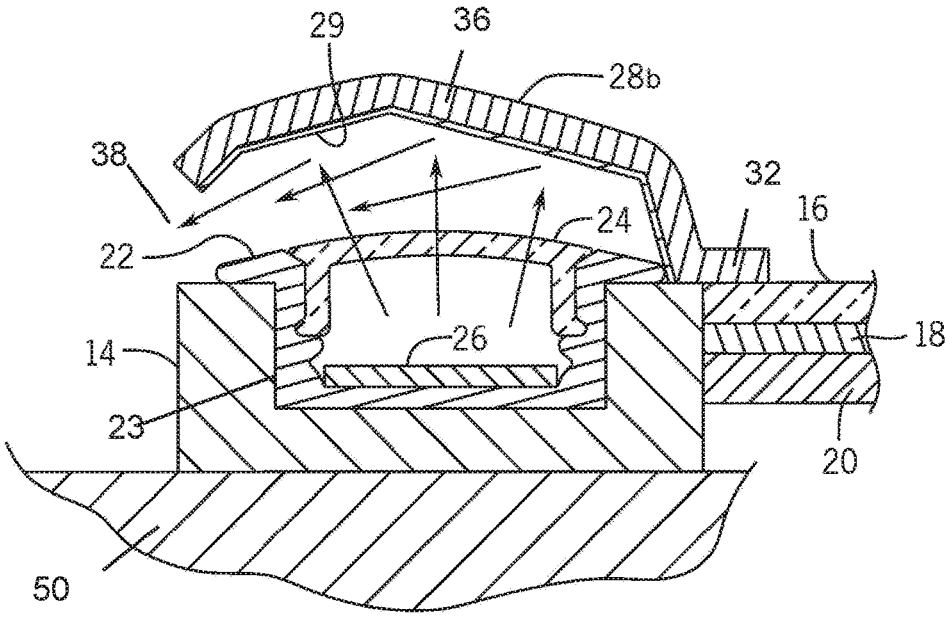
FIG. 2B is a cross-sectional view similar to FIG. 2A showing a second configuration of the backlit.

An alternative embodiment of the diffuser is shown in reference to FIG. 2B. In the embodiment shown in FIG. 2B, the inner surface of the diffuser 28*b* is formed as a substantially flat surface. A reflective layer 29 is provided on the inner surface so as to reflect the light emitted by the LED 26 through the illumination gap 28.

Figure 2C:
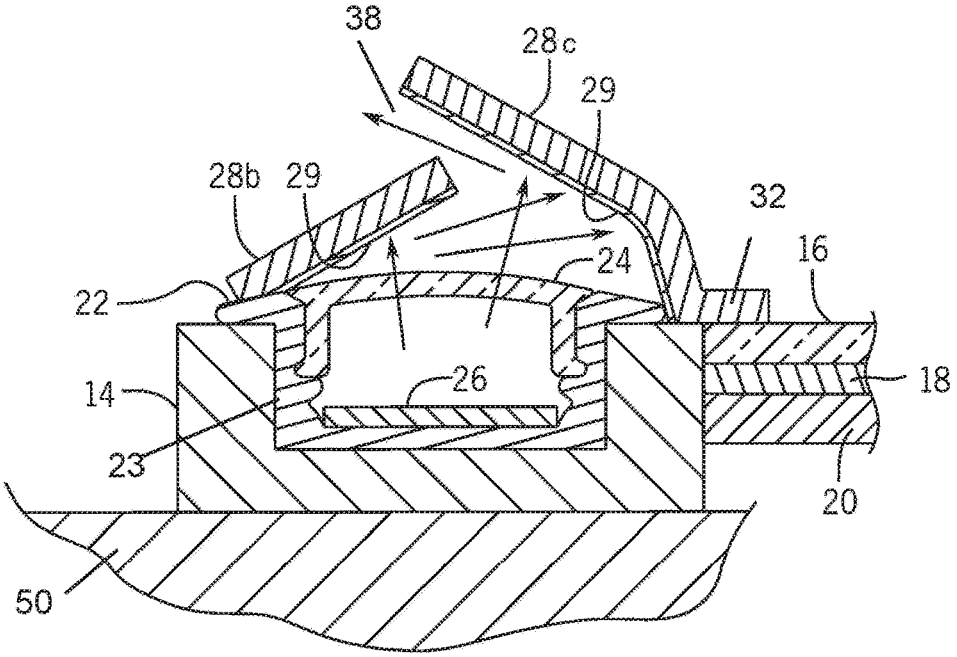
FIG. 2C is a cross-sectional view similar to FIG. 2B showing a third configuration of the backlit frame.
Figure 3:
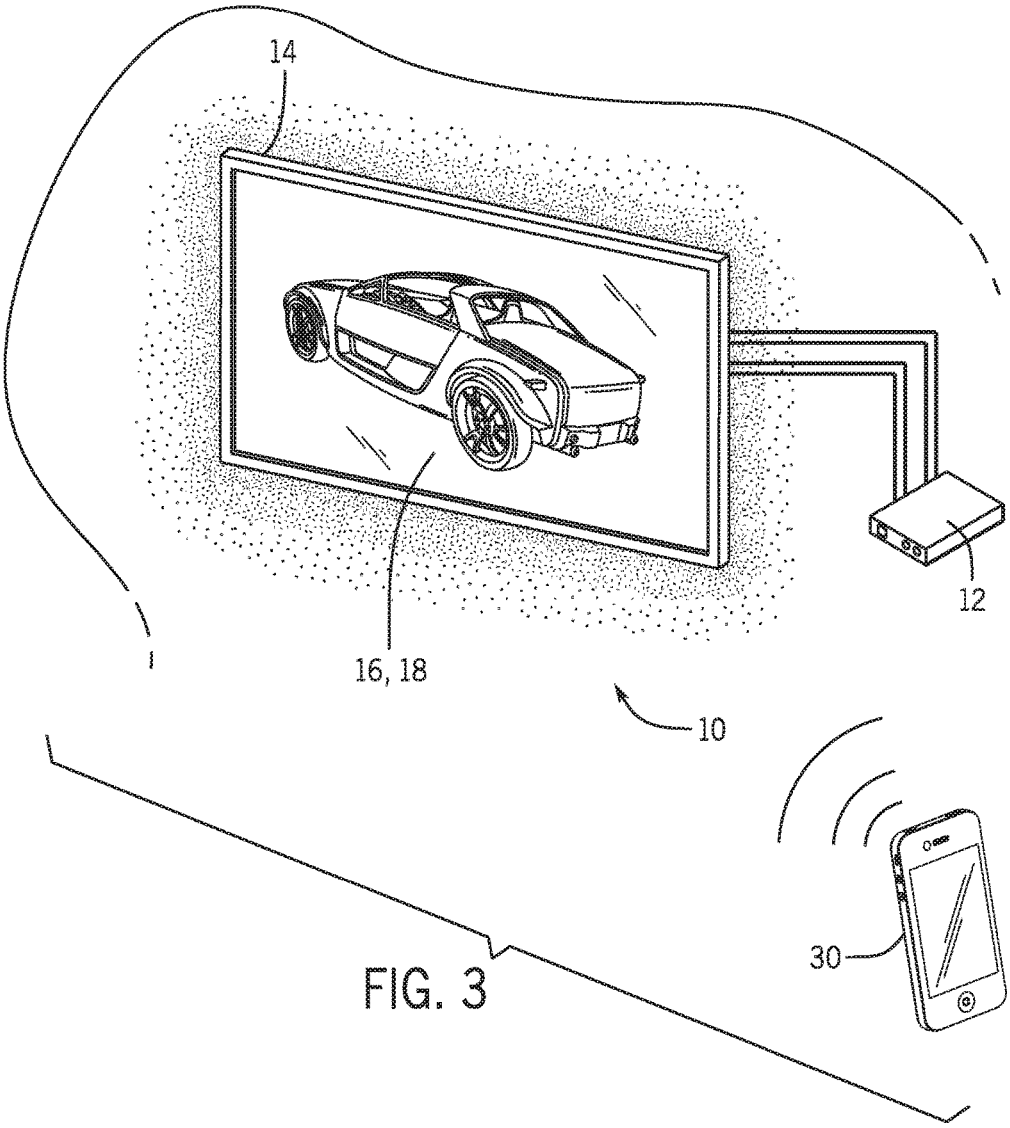
FIG. 3 is a perspective view of the second configuration of the invention.

As seen in reference to FIG. 2C, the frame 14, rail 22, and rail cover 24 are formed in a similar manner as that described above. In this instance, the diffuser 28*b* is of a two part construction. An inner surface of the diffuser 28*b* includes a reflective layer 29 to reflect the light emitted by the LED 26. The two part construction of the diffuser 28*b* includes an interior portion and an exterior portion. The interior portion includes the mounting tab 32 and angle arm 36 that continuously diverges from the rail cover 24. The exterior portion is attached at a first end to the rail 22 and projects inwardly so that a second end is subjacent to the distal end of the interior portion. In this embodiment, the illumination gap 38 is defined between the distal ends of the interior and exterior portions of the diffuser 28*c*.

In one embodiment, the artwork 18 when mounted in the frame 14, is backlit using the LEDs imbedded in the aluminum rail 22, which is mounted in the recessed channel 23. The LED controller 12 can control LED color, behavior flash sequences, and can also be configured respond to audio stimuli using for example, an infrared remote, phone (iPhone, Android and Windows versions) or tablet. In an alternative embodiment, a mobile application 30 can be used to control the LED light scheme. In one embodiment, logic gates within the electronic LED controller 12 can wirelessly sense an input from an infrared remote control, phones, or tablet with appropriate applications.

In an alternative embodiment, LEDs may be surface mounted within the frame and behind artwork. The frame device can be mounted on a wall or may be a standalone configuration and then connected to a micro-computer controller 12 and power supply ranging from 5 to 12 volts. Beneficially, the frame 14 can be used to display static artwork 18 for any purpose.

It should be understood, of course, that the foregoing relates to exemplary embodiments of the invention and that modifications may be made without departing from the spirit and scope of the invention as set forth in the following claims.

What is claimed is:

1. A device for displaying a piece of artwork comprising;
a frame for mounting the artwork, a channel defined in a surface of the frame;
a plurality of LED lights which are integrated with the frame, wherein the LED lights backlight the frame;
a rail received within the channel with the plurality of LED lights are received within the rail;
a light transmitting rail cover received within the rail to cover the plurality of LED lights;
a diffuser attached at a proximal end to the frame and disposed in a spaced relation from the light transmitting cap;
a light emitting gap defined between the diffuser and the frame at a distal end of the diffuser; and
a controller for controlling the LED lights.

2. The device of claim 1, further comprising:
a plurality of light reflective protrusions defined on an inner surface of the diffuser, wherein the plurality of light reflective protrusions reflect a light emitted by the LED through the light emitting gap.

3. The device of claim 2, further comprising:
a snap-fit interface between the light transmitting rail cover and the rail.

4. The device of claim 1, further comprising:
a reflective layer formed on an inner surface of the diffuser, wherein the reflective layer reflects a light emitted by the LED through the light emitting gap.

5. The device of claim 1, further comprising;
the diffuser having a two part construction, including an interior portion and an exterior portion,
a mounting tab defined at a proximal end of the interior portion attached to an inner edge of the frame with an angle arm that continuously diverges from the rail cover extending upwardly and outwardly from the mounting tab and terminating at a distal end; and
the exterior portion is attached at a first end to the rail and projects inwardly so that a distal end of the exterior portion is subjacent to the distal end of the interior portion.

6. The device of claim 5, further comprising:
an illumination gap defined between the distal ends of the interior and exterior portions of the diffuser.

7. The device of claim 1, further comprising;
a substrate occupying an interior space bounded by the frame.

8. The device of claim 7, further comprising:
an artwork mounted to the substrate.

9. The device of claim 8, further comprising:
a transparent layer overlying the artwork.

* * * * *